US009377205B2

(12) United States Patent
Trice et al.

(10) Patent No.: US 9,377,205 B2
(45) Date of Patent: Jun. 28, 2016

(54) OVEN RACK

(75) Inventors: Daniel Joseph Trice, Louisville, KY (US); Cecil Clay Clements, Louisville, KY (US); Robert Dennis Halleron, Louisville, KY (US); James Tomaszewski, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1066 days.

(21) Appl. No.: 13/338,789

(22) Filed: Dec. 28, 2011

(65) Prior Publication Data

US 2013/0167828 A1 Jul. 4, 2013

(51) Int. Cl.

| | |
|---|---|
| ***C23C 30/00*** | (2006.01) |
| ***F24C 15/16*** | (2006.01) |
| *F24C 15/08* | (2006.01) |

(52) U.S. Cl.

CPC ..... *F24C 15/16* (2013.01); *F24C 15/08* (2013.01); *F24C 15/168* (2013.01); *Y10T 29/49982* (2015.01); *Y10T 29/49996* (2015.01)

(58) Field of Classification Search

CPC ..... F24C 15/16; F24C 15/08; F24C 15/168; C23C 30/00; C23D 5/00; A21B 3/155

USPC ..... 126/339, 337 R, 332, 337 A, 340, 390.1, 126/275 R; 52/670, 799.1; 99/325, 458

See application file for complete search history.

(56) References Cited

U.S. PATENT DOCUMENTS

| | | | | |
|---|---|---|---|---|
| 286,142 | A | 10/1883 | Marvin | |
| 434,970 | A * | 8/1890 | Allyn | 126/339 |
| 1,259,210 | A * | 3/1918 | Clark | 52/799.1 |
| 1,351,415 | A | 8/1920 | Coumerilh | |
| 2,076,099 | A * | 4/1937 | Smith et al. | 211/153 |
| 3,358,119 | A * | 12/1967 | Sisco | 219/391 |
| 4,176,591 | A * | 12/1979 | Power | 99/430 |
| 5,605,143 | A * | 2/1997 | Hebert | A21B 3/16 126/41 R |
| 5,870,946 | A * | 2/1999 | Dudley | F24C 15/16 99/400 |
| 6,279,469 | B1 * | 8/2001 | Bailey | A21B 3/15 220/573.1 |
| 6,837,235 | B2 | 1/2005 | Blankenship | |
| 6,915,552 | B2 | 7/2005 | Blankenship | |
| 7,290,320 | B2 | 11/2007 | Blankenship | |
| 2003/0038137 | A1 * | 2/2003 | Tingley | 220/573.1 |
| 2003/0172921 | A1 | 9/2003 | Blankenship | |
| 2005/0121439 | A1 | 6/2005 | Blankenship | |
| 2006/0225725 | A1 * | 10/2006 | Rinaldo | A47J 37/0763 126/9 R |
| 2007/0261694 | A1 * | 11/2007 | Le et al. | 126/339 |
| 2008/0217341 | A1 * | 9/2008 | Wolever et al. | 220/573.1 |
| 2008/0237166 | A1 * | 10/2008 | Williams et al. | 211/169.1 |
| 2010/0218755 | A1 * | 9/2010 | Stewart et al. | 126/339 |

FOREIGN PATENT DOCUMENTS

| | | | |
|---|---|---|---|
| JP | 2005257216 | A2 | 9/2005 |
| JP | 2007189940 | A | 8/2007 |

* cited by examiner

*Primary Examiner* — Gregory Huson
*Assistant Examiner* — Nikhil Mashruwala
(74) *Attorney, Agent, or Firm* — Dority & Manning, P.A.

(57) ABSTRACT

A rack for an oven includes a sheet of metal having a front edge, a back edge, opposing side edges, a top surface and a bottom surface. A row of punched openings is formed in the metal sheet, with a solid region of metal adjacent to the row of punched openings. A stiffening rib is formed in a surface of the rack in the solid region of metal having a substantially semi-circular, indented cross-section.

17 Claims, 4 Drawing Sheets

OVEN RACK

BACKGROUND

The present disclosure generally relates to appliances, and more particularly to a rack for a cooking oven.

Oven racks are typically formed from interconnected sections of elongated steel wire. The sections of wire are arranged so that the lengths intersect to form a surface on which a cooking utensil, such as a cooking sheet, can be placed. Such wire racks when coated with porcelain have a substantially non-stick surface that can withstand high cooking and self-cleaning temperatures.

The typical wire rack used in an oven rack can be difficult to clean due to the generally small diameter size of the wire sections as well as the number of wire sections that are required to make up the rack. The smaller size of the wire sections of the wire rack may also pose stability problems for smaller sized cooking utensils. Depending upon the size of the cooking utensil, it also may not be possible to place the cooking utensil directly on the wire rack without a supporting surface underneath the cooking utensil. For example, a small bowl or cup like utensil is not stable resting on two wires, such as are found on the traditional wire oven rack.

Accordingly, it would be desirable to provide a cooking rack for an oven that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to a rack for an oven. In one embodiment, the rack includes a sheet of metal having a front edge, a back edge, opposing side edges, a top surface and a bottom surface. A row of punched openings is formed in the metal sheet, with a solid region of metal adjacent to the row of punched openings. A stiffening rib is disposed along the bottom of the rack in the solid region of metal, the stiffening rib having a substantially semi-circular, indented cross-section.

Another aspect of the disclosed embodiments is directed to a cooking rack for an oven. In one embodiment, the cooking rack includes a frame having a front, back and opposing side edges; a cooking utensil supporting surface within the frame, the cooking utensil supporting surface having one or more punch formed openings arranged in rows; a stiffening member extending in a solid region of the cooking utensil supporting surface from one side to an other side of the cooking utensil supporting surface, the stiffening member formed in a surface of the cooking utensil supporting surface.

Another aspect of the disclosed embodiments relates to a method of making a coated oven rack. In one embodiment the method includes providing a sheet of temperature resistant material, the sheet having a front edge, a rear edge and opposing side edges; punching at least one row of openings in the sheet, the rows extending from one side of the sheet to another; rolling each side edge of the sheet into a substantially tubular form, the tubular form having an open side; bending the front edge of the sheet in a downward facing direction; bending the rear edge of the sheet in an upward facing direction; rolling each edge of each opening into a swept back substantially cylindrical member; and coating the punched sheet with a temperature resistant, non-stick coating.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
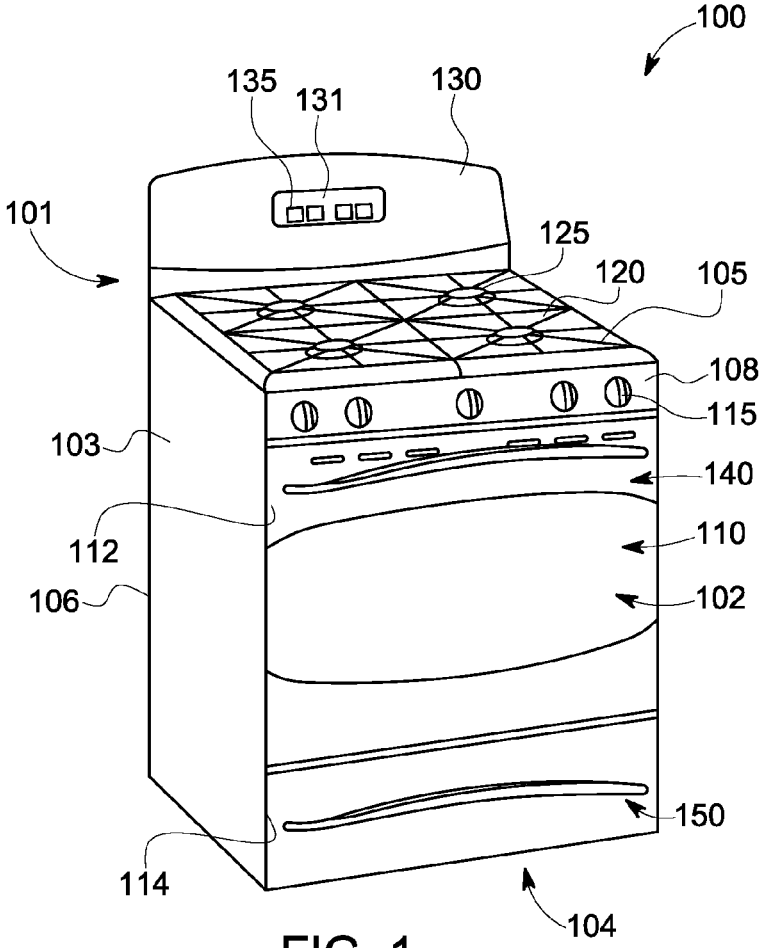
FIG. 1 is a perspective view of an exemplary range incorporating aspects of the disclosed embodiments.

Referring to FIG. 1, an exemplary appliance such as a free standing range in accordance with the aspects of the disclosed embodiments is generally designated by reference numeral 100. The aspects of the disclosed embodiments are directed to a rack for a cooking appliance, such as an electric or gas oven. The rack is formed by stamping or punching openings in a metal sheet. A temperature resistant, non-stick coating can be applied to the stamped metal sheet. The stamped metal sheet can also include rolled edges around the openings and side of the sheet, as well as stiffening ribs. The oven rack of the disclosed embodiments provides a light weight structure with improved strength and provides a generally flat, planar surface on which small utensils, such as a small bowl or cup, can rest in a relatively stable manner. By stamping or punching the openings into the metal sheet, different design looks and functionalities can be applied. Although the aspects of the disclosed embodiments are generally described herein with respect to a cooking appliance, in alternate embodiments any device having a heating chamber that includes a rack or similar supporting surface on which items can be placed for heating or drying, can be contemplated.

As is shown in FIG. 1, the range 100 includes a cabinet or housing 101 that has a front portion 102, opposing side panels 103, a base portion 104, a top portion 105, and a back panel 106. In one embodiment, the top portion 105 of the oven 100 includes a cooktop 120. The housing 101 forms a support for the cooktop 120. As is shown in FIG. 1, the cooktop 120 includes one or more surface heating units or burner elements, generally referred to as surface heating units 125.

The range 100 also includes an oven unit 110. The housing 101 forms a support for the oven unit 110, which can include for example, a main oven cavity 140 and a warming cavity 150, shown in FIG. 2. Although the aspects of the disclosed embodiments are described herein with respect to the single oven configuration shown in FIG. 1, in alternate embodiments, the range 100 could comprise a multiple oven unit.

In the embodiment shown in FIG. 1, the range 100 includes an oven door 112 and a pullout drawer 114, the operation of which is generally understood. The oven door 112 covers an opening to the oven cavity 140, while the pullout drawer 114 provides access to the warming cavity 150, shown in FIG. 2.

In one embodiment, the cabinet 101 of the range 100 includes a control surface 108 that supports one or more controls, generally referred to herein as burner control 115. The burner control 115 shown in FIG. 1 is generally in the form of a knob style control. Although the aspects of the disclosed embodiments will generally be described herein with respect to control knobs, in alternate embodiments, any suitable control switches, such as push button or electronic switches, can be used to regulate a state or mode of each of the surface heating units 125.

The cabinet 101 also includes a control panel 130, also referred to as a user interface. The control panel 130 can also include a display 131. One aspect of the control panel 130 is to control the general operations of the range 100, including the oven 110 and cooktop 120, as well as provide feedback to the user. The control panel 130 can include one or more controls or switches 135 that can be used to provide control inputs and commands for one or more of the functions of the range 100, including the oven 110 and cooktop 120. In one embodiment, the controls 135 can be in the form of push buttons or electronic switches.

Figure 2:
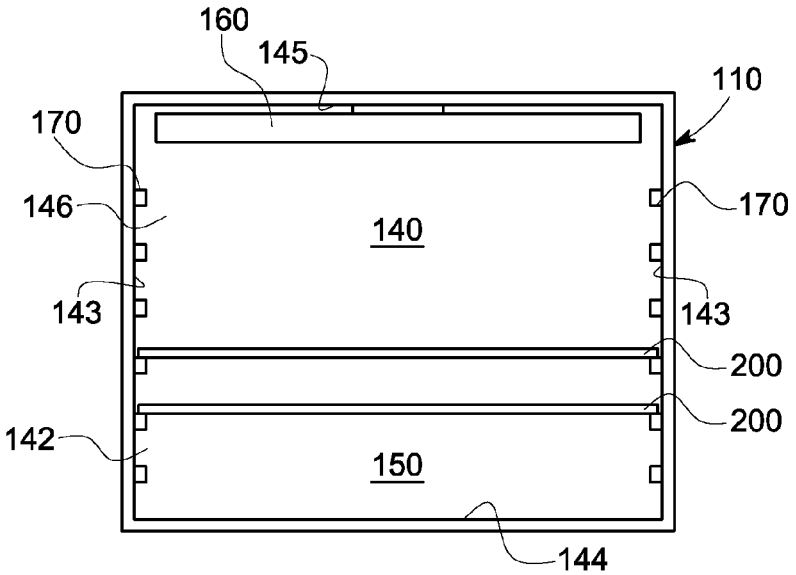
FIG. 2 is a front view of the oven cavity for the oven shown in FIG. 1

FIG. 2 illustrates a front view of the oven unit 110 of the range 100 incorporating aspects of the disclosed embodiments. The housing 101 forms a frame or support for the cooktop 110 as well as internal cavities, such as the oven cavity 140 and the warming drawer 150. In one embodiment, a separate cavity can be provided for the warming drawer 150 (not shown in this example), other than including oven cavity 140. The oven cavity 140 includes a heating source, which, in this example, is an electric heater 160 is disposed within the oven cavity 140. Alternatively, a gas burner could be used as the heating source for cooking and self-cleaning.

Referring also to FIG. 2, the oven cavity 140 is generally defined by an oven cavity liner 141 that includes opposing left and right sides 143, a base 144, top 145 and back 146. The door 112 to the oven cavity 140 will form a front portion (not shown) of the oven cavity liner 141. The oven cavity 140 may have any suitable dimensions and includes one or more rack supports 170. The rack supports 170 are located at spaced apart positions for holding one or more oven racks 200 in place, so that food items and cooking utensils may be placed on the oven rack(s) 200 for cooking.

The oven cavity liner 141 is generally formed from a temperature resistant material, such as carbon steel, for example. In alternate embodiments, the oven cavity liner 141 and other cooking surfaces can include any suitable material or substrate that is heat-stable and can be coated with a temperature resistant, non-stick coating, as is generally known.

Figure 3:
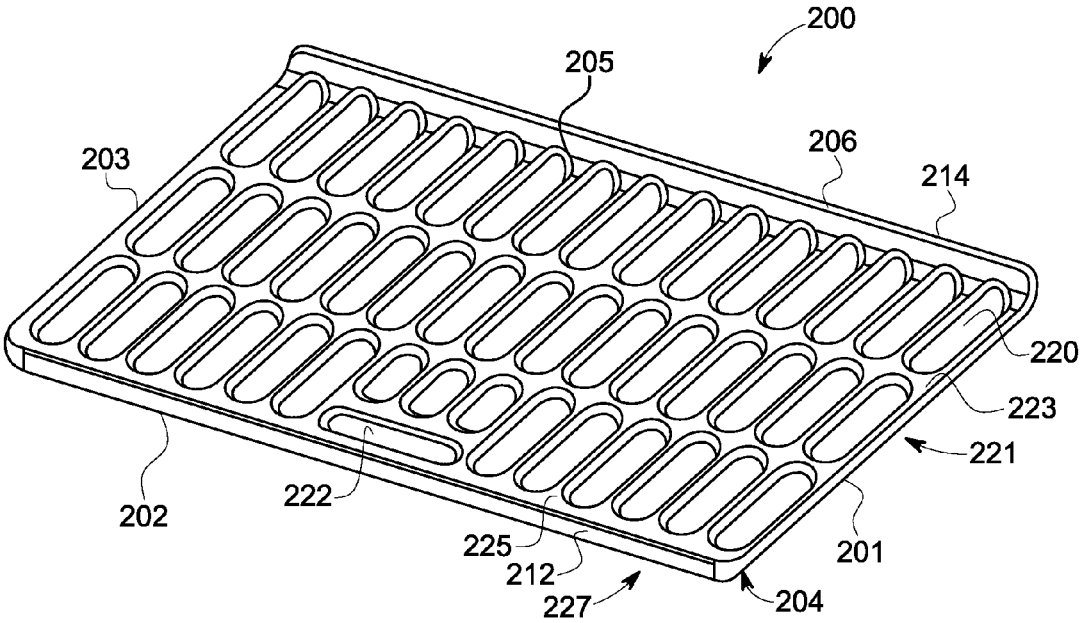
FIG. 3 is a perspective view of an exemplary rack for an oven according to an embodiment of the present disclosure.

FIG. 3 is a perspective view illustrating a stamped metal oven rack 200 incorporating aspects of the disclosed embodiments. The rack 200 includes a front 202, opposing right and left sides 201, 203, a bottom side 204, top side 205 and rear or back 206. The front 202 will typically be adjacent to the door 112 of the oven cavity 140. In one embodiment, the front 202 of the rack 200 includes a front lip or edge 212 and the rear 206 of the rack 200 can include a rear edge or lip 214. The front lip 212 is generally downturned toward the bottom of the oven cavity 140, while the rear edge 214 is upturned.

The rack 200 is generally formed from a sheet of metal or other rigid temperature resistant material. As is shown in FIG. 3, the rack 200 includes one or more openings 220. The openings 220 are formed by stamping or punching the sheet of metal. In the example of FIG. 3, the openings 220 are generally arranged in rows 221 and columns 227. An area 223 of solid sheet material extends from one side 201 to the other side 203 between the rows 221, while an area 225 of solid sheet material extends from the front 202 to the back 206.

An opening 222 extends along or adjacent to the front 202 of the rack 200 and is shaped and oriented to provide a gripping area or handle for the rack 200 that allow the rack 200 to be gripped for moving the rack 200 into and out of the oven cavity 140 as will generally be understood.

In one embodiment, the rack 200 with the punched openings 220 can be coated by any one of a number of coatings suitable for use in an oven. These coatings can include, but are not limited to non-stick high temperature coatings such as porcelain, copper, nickel and stainless steel. The coatings generally provide a suitable temperature resistant, non-stick surface that is easily cleanable and can withstand the self-cleaning temperatures of an oven, which can in some cases reach approximately 800 degrees Fahrenheit.

Figure 4:
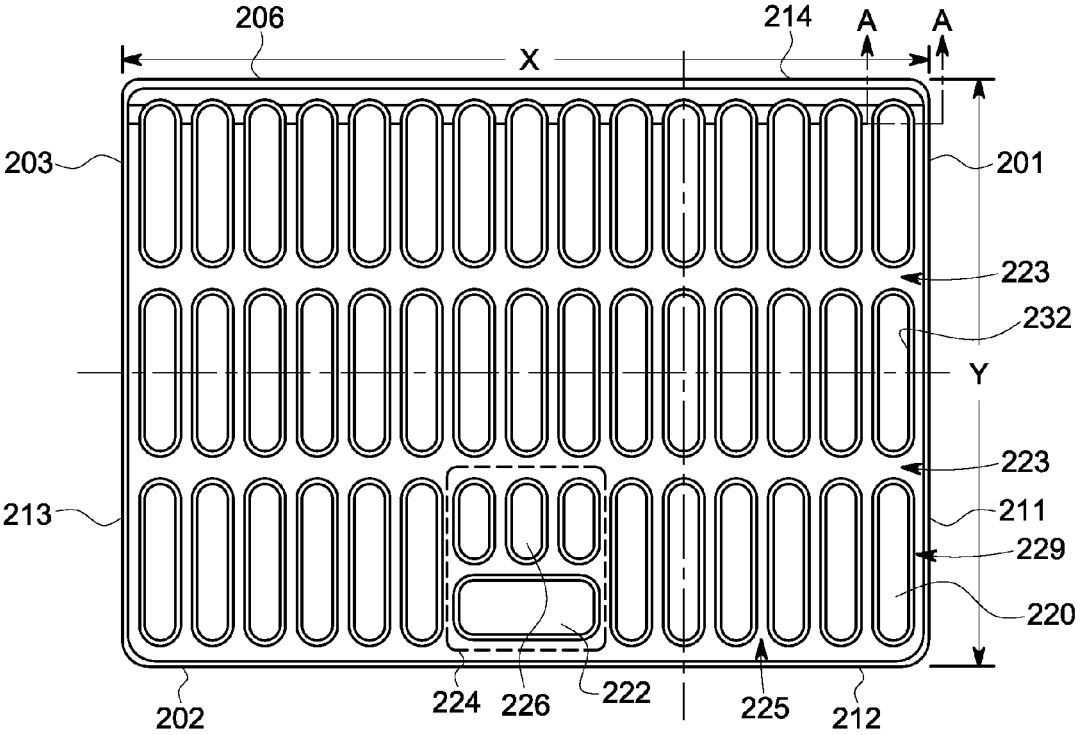
FIG. 4 is a top view of the rack shown in FIG. 3.

FIG. 4 is a top view of the rack 200 shown in FIG. 3. The rack 200 is suitably sized to be accommodated in the typical oven. In one embodiment, a width X of the rack 200 extending substantially side to side in the oven cavity liner 141 is in the range of approximately 23 to 24 inches, or such other suitable dimension as required to accommodate the width of the corresponding oven cavity 140. A depth Y of the rack 200 running substantially from the front 142 of the oven cavity 140 to the back 146 can be in the range of approximately 17 to 18 inches, or such other suitable dimension to accommodate the desired depth of the corresponding oven cavity.

In the embodiment shown in FIG. 4, the rack 200 includes three rows 221 of openings 220 running from one side 201 to the other side 203 of the rack 200. Although only three rows 221 are illustrated in the exemplary rack 200 of FIG. 4, in alternate embodiments, the rack 200 can include any suitable number of rows, including more or less than three. Additionally, although the example of FIG. 4 shows the openings 220 having a longer side running in a front to back orientation, in alternate embodiments, the longer side of the openings 220 can be oriented side to side.

As is shown in the exemplary rack 200 of FIG. 4, each row 221 includes approximately fifteen (15) suitably sized openings 220, although more or less openings could be included depending upon the desired configuration and the dimensions of the rack 200. The three rows 221 of fifteen openings 220 in this example form fifteen columns 227 that extend substantially from the front 202 of the rack 200 to the rear 206 of the rack 200. The openings 220 in each column 227 are substantially aligned with one another.

In one embodiment, each opening 220 has a shape that is substantially oblong, in the shape of a rectangle with rounded ends, longer in one direction than the other. In alternate embodiments, the openings 220 can be any suitable or desired geometric shape, such as square or oval. In one embodiment, each opening 220 has an approximate length of 4.5 inches and an approximate width of 15/16 inches. In alternate embodiments, the length and width of each opening 220 can be any suitable size that provides a stable supporting surface for the rack 200, while promoting suitable air flow through the rack 200. For example, the working or top surface 205 of the oven rack 200 is configured to be wide and substantially flat so as to be able to accommodate different sized cooking utensils, including smaller sized cooking utensils such as small bowls and cups, without allowing the cooking utensil to be unstable or turn over. The typical wire type oven racks do not provide such a flat, stable surface, due to the rounded shape of the wires.

In the example shown in FIG. 3, the row 229, which is closest to the front 202 of the rack 200, also includes the handle opening 222 in an approximate center area of the row 225, closest to the front edge 212. The handle opening 222 of the rack 200 is generally formed in the area defined as 224. In one embodiment, the handle opening 222 is oriented in a side-to-side fashion and is shaped or configured to function as a handle or other pushing and pulling mechanism that allows the user to move the rack 200 into and out of the oven cavity 140, using a suitable heat resistant tool, such as a mitt or gripping tool.

To accommodate the orientation and size of the handle opening 222, the openings 226 within the area 224 are smaller in size than the openings 220. In one embodiment, the handle opening 222 has a length or side to side dimension of approximately 1 7/16 inches and a width or front to back dimension in the range of 1 to 2 inches, while each opening 226 has a length of approximately 2.5 inches and a length of approximately 15/16 inches. In alternate embodiments, the openings 222 and 226 can have any suitably sized or desired dimensions, other than including those identified herein.

Between each row 221 of openings 220, the area 223 of substantially solid material of the rack 200 is referred to herein as the widthwise gap region. The widthwise gap region 223 runs substantially from side to side 201, 203 along the rack 200. In one embodiment, the dimensions of the widthwise gap region 223 are approximately 13/16" inches by 23 inches.

The area 225 between each opening 220, running substantially from the front edge 202 of the rack 200 to the rear edge 206 of the rack 200 is generally referred to herein as the depthwise gap region. The dimensions of each depthwise gap region 225 is approximately ½ inches by 16½" inches.

In the embodiment shown in FIG. 3, the front 202 of the rack 200 includes a front edge or lip 212. In one embodiment, the front lip 212 is generally downward facing and can provided added strength to the rack 200 as well as provide a grip portion that can be pulled on to move the rack 200 into and out of the oven cavity 140. Although the front lip 212 is shown in FIG. 3 as extending from one side 201 to the other side 203 of the rack 200, in one embodiment, the front lip 212 can encompass only a portion of the width of the rack 200, such as the center area 224 shown in FIG. 4. In one embodiment, the rear 206 of the rack includes rear lip 214, which in this example is shown as generally upward facing. The rear lip 214 can provide added strength to the rack 200 as well as prevent cooking utensils or other items on the rack 200 from sliding off the back edge 206.

Figure 5:
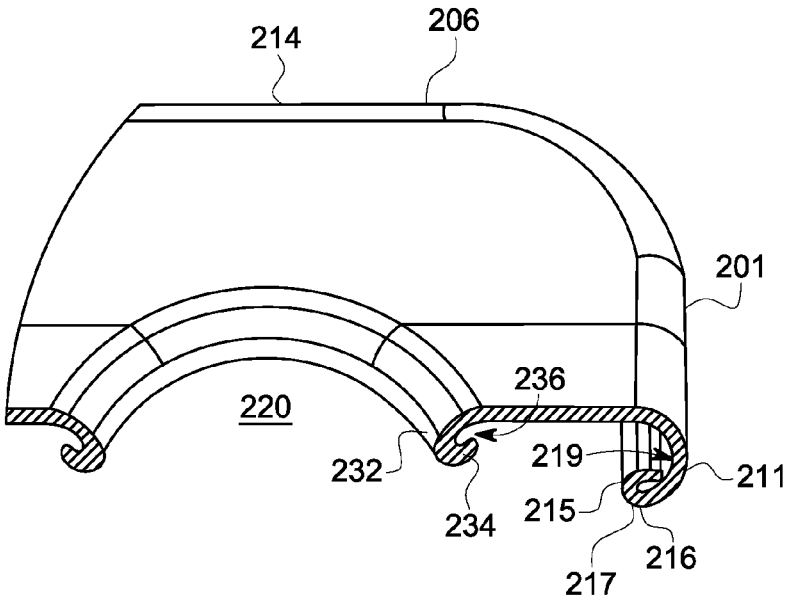
FIG. 5 is a partial cross-sectional front view of the rack shown in FIG. 4.

FIG. 5 illustrates a partial cross-sectional view of the rack 200 taken along the line A-A in the top right corner. The entire form or rack 200 is stamped from a rectangular metal blank. The sides 232 of the each opening 220 is hemmed or swept back underneath the rack 200. As is shown in FIG. 5, the opening 220 has a rounded or hem portion 234, also referred to as an open hem. In one embodiment, a substantially cylindrical area 236 is formed around each opening 220. Generally, the oven rack 200 is formed flat and then bent up in the back 234 giving an up sweep look in the back 234.

As is shown in FIG. 5, in one embodiment, the edge 211 of the side portion 201 of the rack 200 is a folded over or rolled edge (the opposite edge is 213, shown in FIG. 4). The rolled edge 211 is substantially tubular or cylindrical in form and cross-section, and is formed along the periphery of the side 201 of the rack 200. The edge 211 is configured to mate or interface with the rack supports 170 in the oven cavity 140 in order to support the rack 200 in a suitable position within the oven cavity 140. As is shown in FIG. 5, the rolled section 215 of the edge 211 extends past a bottom dead center point 216 to provide a wear surface 217 that mates with the corresponding area of the support 170. The rolled section 215 is in the form of a hem, substantially hollow and open along a side 219 to provide draining during the finishing process in manufacturing. Although not shown in FIG. 5, the opposite side 203 includes a similar rolled edge.

Figure 6:
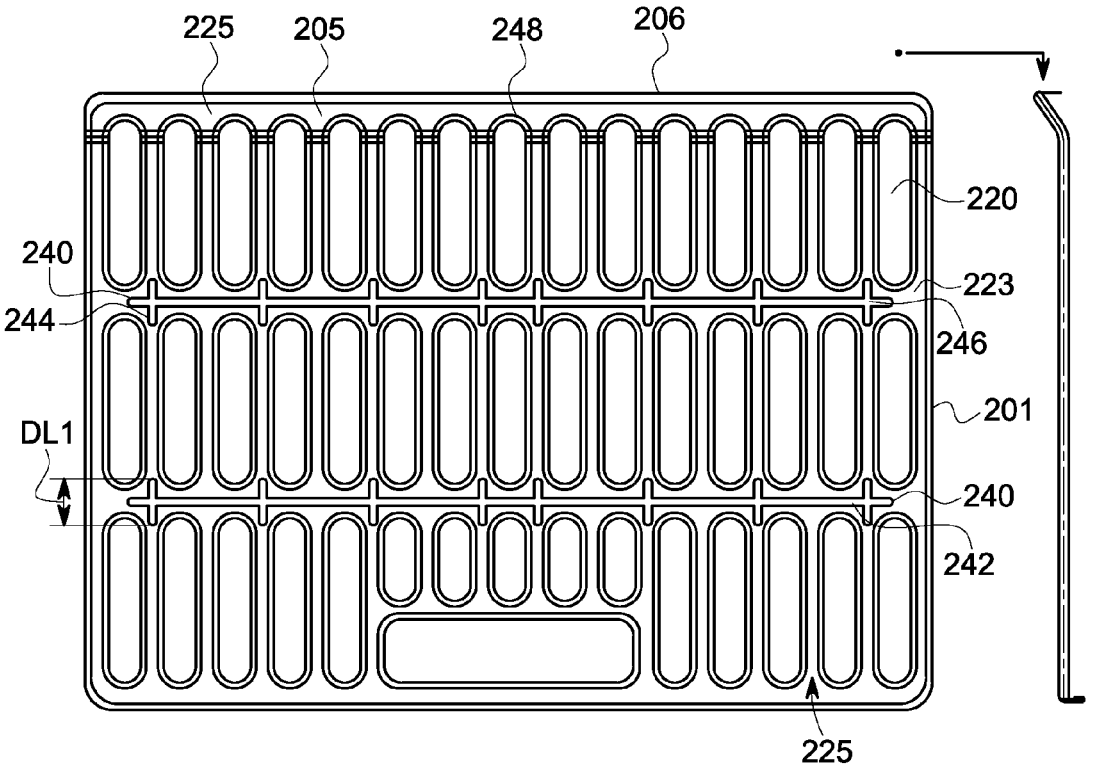
FIG. 6 is a top view of the rack shown in FIG. 4 with the stiffening ribs.

Referring to FIG. 6, in one embodiment, a stiffening or rib member 240 is formed in a top or bottom surface of the oven rack 200. In the example of FIG. 6, the stiffening member 240 is formed in the top surface 205 of the rack 200. The stiffening member 240 is formed in the substantially solid or unpunched region 223 between the rows 221 of openings 220. The stiffening member 240, which in the example of FIG. 6 includes two such members, are generally configured to provide stiffening and support to the rack 200. The stiffening members 240 are formed by compression of the rack 200 to form a substantially semi-circular indented member 242 in the surface 205 of the rack 200. In one embodiment, a width of the stiffening member 240 is approximately 3/16 inches, while a depth of the indentation is approximately 3/16" inches.

As is shown in FIG. 6, in one embodiment, a depthwise, or front to back, indentation 244 can be formed at an intersection of the stiffening member 240 and one or more of the depthwise gap areas 225 to from a cross-member 246. The depthwise length DL1 of each indentation 244 can be approximately 1.5 inches, while a width is approximately 3/16 inches. As is shown in FIG. 6, the indentations 244 and cross-members 246 are staggered, substantially every other gap area 225. In a center area or column of the rack 200, the indentations 244 can be formed on either side of the centermost openings 248 to provide added strength and stiffness to the rack 200.

Figure 7:
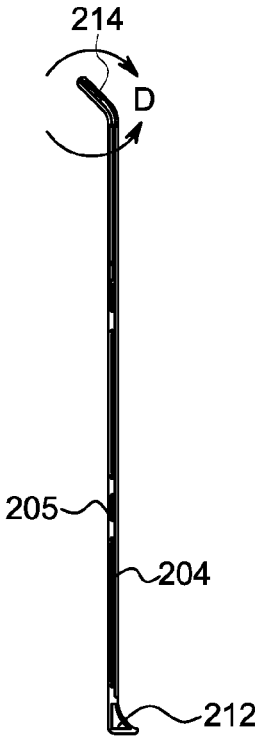
FIG. 7 is a side profile view of the rack shown in FIG. 4.
Figure 8:
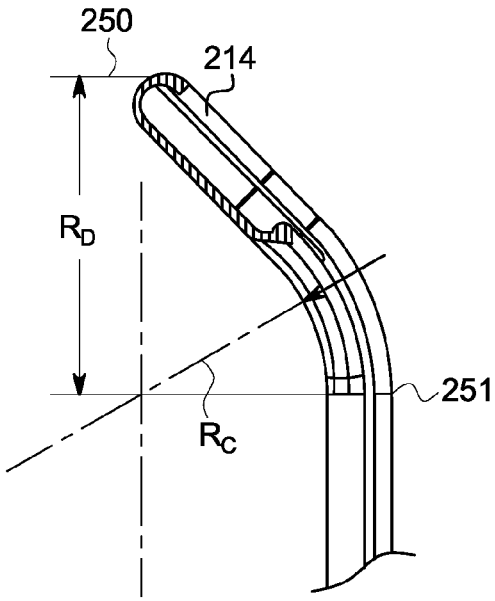
FIG. 8 is a detailed view of the rear corner section of the rack shown in FIG. 7.

FIG. 7 illustrates a side profile view of the rack 200 of FIG. 4, while FIG. 8 illustrates an expanded view of detail section D in FIG. 7. As shown in this example, the rear edge 214 of the rack 200 is upturned. In one embodiment, the rear edge 214 is swept up as a detent to keep the rack 200 from coming out of the track formed by the rack supports 170 when loaded. Typically, rear edge 214 requires the rack 200 to be raised up in order to remove it. This prevents the user from sliding the rack 200 too far forward and out of the rack supports when the rack 200 is loaded.

As illustrated in FIG. 8, the radius of curvature $R_C$ of the upturned rear edge 214 is approximately 0.75 inches. A distance $R_D$ from an end 250 of the upturned edge 214 to the end 251 of the rack 200 where the upturned edge 214 begins is approximately 1.3 inches. An intersection of substantially straight lines from the end 250 and the end 251 aligns substantial with an approximate center of the radius of curvature $R_C$.

The aspects of the disclosed embodiments provide an oven rack that is formed by punching or stamping openings in a metal sheet. The oven rack can be coated with a high temperature, non-stick coating. The openings in the surface of the rack provide for suitable air flow through the metal sheet, while providing a generally flat, stable surface on which items to be heated or cooked, including cooking utensils, can be placed. The substantially flat surface allows smaller cooking utensils, such as cups and small bowls to be placed on the rack in a relatively stable manner. The flat surfaces also enable easier cleaning of the cooking surface as compared to the typical wire type racks. The side edges of the oven rack of the disclosed embodiments are generally rolled, to provide more stability along the sides, as well as to provide control surfaces or edges. The front edge of the rack can be downturned to provide a gripping or control surface that can be used to move the rack into and out of the oven cavity. The sides or edges of each opening can also include swept back or rolled edges. Stiffening ribs can be included along a surface of the rack, generally running between the pattern of stamped openings, that provide stability to the rack.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rack for an oven, comprising:

a sheet of metal having a front edge, a back edge, opposing side edges, a top surface and a bottom surface;

a row of punched openings in the metal sheet, each of the punched openings in the row of punched openings including a side member having a hem swept back underneath the rack;

a solid region of metal adjacent to the row of punched openings; and a stiffening rib formed in a surface of the rack in the solid region of metal, the stiffening rib having a substantially semi-circular, indented cross-section.

2. The rack of claim 1, further comprising a temperature resistant, non-stick coating on the rack.

3. The rack of claim 1, further comprising at least one other row of punched openings, with a solid region of metal between each row, the rows of punched openings forming columns of openings, with a solid region of metal between each column.

4. The rack of claim 3, wherein a stiffening rib is formed in the solid region of metal between each row of punched openings.

5. The rack of claim 4, further comprising an indented region of metal formed at an intersection of the stiffening rib and the solid region of metal between each column.

6. The rack of claim 4, wherein each stiffening rib extends from substantially one side of the rack to the other side of the rack.

7. The rack of claim 1, wherein the row of punched openings extends from one side of the rack to another side of the rack.

8. The rack of claim 1, further comprising a handle member along the front of the rack, the handle member being formed from an opening punched in the metal sheet.

9. The rack of claim 1, further comprising a downturned lip member extending from the front of the rack.

10. The rack of claim 1, comprising an upturned lip member extending from the rear of the rack.

11. The rack of claim 1, further comprising a substantially hollow partially cylindrical member on each side of the rack, the substantially hollow cylindrical member extending downwards from the bottom of the rack, the substantially hollow cylindrical member being open on each end.

12. The rack of claim 11, wherein a bottom dead center region of each cylindrical member is configured to mate with a rack supporting surface of the oven.

13. A cooking rack for an oven, comprising:

a frame having a front, back and opposing side edges;

a cooking utensil supporting surface within the frame, the cooking utensil supporting surface having one or more punch formed openings, each of the one or more punched openings including a side member having a hem swept back underneath the rack; and a stiffening member extending in a solid region of the cooking utensil supporting surface from one side to another side of the cooking utensil supporting surface, the stiffening member formed in a surface of the cooking utensil supporting surface.

14. The rack of claim 13, wherein the punched openings are arranged in substantially linear rows and the stiffening member is disposed between the rows of punched openings.

15. The rack of claim 13, further comprising:

a downward facing lip extending from the front of the frame; and an upward facing lip extending from the back of the frame.

16. The rack of claim 13, further comprising a handle member in the cooking utensil surface along the front of the frame, the handle member formed by a handle opening punched in the cooking utensil supporting surface.

17. The rack of claim 13, further comprising a temperature resistant, non-stick coating on the cooking utensil supporting surface.

* * * * *